US008678303B2

(12) United States Patent
Capano

(10) Patent No.: US 8,678,303 B2
(45) Date of Patent: Mar. 25, 2014

(54) WATTMETER CIRCUIT FOR OPERATING A GRINDER PUMP ASSEMBLY TO INHIBIT OPERATING UNDER RUN DRY OR BLOCKED CONDITIONS

(75) Inventor: David Capano, Greenfield Center, NY (US)

(73) Assignee: Environment One Corporation, Niskayuna, NY (US)

( * ) Notice: Subject to any disclaimer, the term of this patent is extended or adjusted under 35 U.S.C. 154(b) by 747 days.

(21) Appl. No.: 12/600,129

(22) PCT Filed: May 14, 2008

(86) PCT No.: PCT/US2008/006134

§ 371 (c)(1),
(2), (4) Date: Nov. 12, 2010

(87) PCT Pub. No.: WO2008/143859

PCT Pub. Date: Nov. 27, 2008

(65) Prior Publication Data

US 2011/0109171 A1 May 12, 2011

Related U.S. Application Data

(60) Provisional application No. 60/917,844, filed on May 14, 2007.

(51) Int. Cl.
*B02C 25/00* (2006.01)

(52) U.S. Cl.
USPC ..... 241/21; 241/30; 241/36; 241/46.017

(58) Field of Classification Search
USPC ..... 241/21, 30, 46.017, 36
See application file for complete search history.

(56) References Cited

FOREIGN PATENT DOCUMENTS

| | | | |
|---|---|---|---|
| EP | 1134421 | A1 | 9/2001 |
| JP | 09014148 | A | 1/1997 |
| JP | 10205457 | A | 8/1998 |
| JP | 200112359 | A | 1/2001 |
| JP | 200382716 | A | 3/2003 |

OTHER PUBLICATIONS

International Search Report for PCT/US2008/006134 dated Oct. 30, 2008.
Written Opinion of the International Searching Authority mailed Oct. 30, 2008 (5 pages).

*Primary Examiner* — Mark Rosenbaum
(74) *Attorney, Agent, or Firm* — Heslin Rothenberg Farley & Mesiti P.C.

(57) ABSTRACT

A method for operating a grinder pump station and inhibiting the likelihood of operation of a grinder pump assembly under at least one of a run dry condition and a blocked condition includes providing a wattmeter circuit operably connected to the grinder pump assembly and measuring real power using the wattmeter circuit during operation of the grinder pump assembly to process sewage received in a tank and discharge the processed sewage from the tank. The grinder pump assembly is automatically turned off based on the real power (e.g., average value of the product of instantaneous values of voltage and current over time) measured by the wattmeter circuit due to the at least one of a run dry condition and a blocked condition.

33 Claims, 6 Drawing Sheets

WATTMETER CIRCUIT FOR OPERATING A GRINDER PUMP ASSEMBLY TO INHIBIT OPERATING UNDER RUN DRY OR BLOCKED CONDITIONS

CLAIM TO PRIORITY AND CROSS-REFERENCE TO RELATED APPLICATIONS

This application is a 371 national stage filing of PCT International Application No. PCT/US2008/06134 filed on May 14, 2008, and published in English on Nov. 27, 2008, as WO 2008/143859, which claims the benefit of U.S. Provisional Application No. 60/917,844, filed May 14, 2007, entitled "Grinder Pumps And Components Therefor," the entire subject matter of which these applications is hereby incorporated herein by reference.

This application is also related to commonly owned pending U.S. Utility patent application Ser. No. 11/748,231, filed May 14, 2007, entitled "Wireless Liquid Level Sensing Assemblies And Grinder Pump Assemblies Employing The Same" by Capano et al., and commonly owned pending U.S. Design patent application Ser. No. 29/280,014, filed May 14, 2007, entitled "Grinder Pump Assembly" by Henry et al. The entire subject matter of these applications is hereby incorporated herein by reference.

FIELD OF THE INVENTION

This invention relates generally to motors, and more particularly to motor cut-out devices for determining an abnormal condition and turning off the motor such as a grinder pump to protect the motor or other associated equipment such as the stator of the pump.

BACKGROUND OF THE INVENTION

Grinder pumps are often used in low pressure sewage systems for pumping sewage. A grinder pump is typically disposed in a sewage tank in which the grinder pump includes a motor for driving a grinder mechanism for cutting or grinding solids or semisolid matter in the sewage and a pump for pumping the processed sewage. Grinding solids and/or semisolid matter in the sewage allows the resulting particulate effluent to be transferred using a pump through relatively small diameter pipes without clogging.

Grinder pump systems are typically equipped with level sensors and a controller and an alarm. When the sewage reaches a certain level in the tank, the pump is automatically switched on and when the sewage in the tank falls below a certain level, the pump is automatically turned off. If the level rises too high, typically another sensor activates an alarm. Conventional level sensors include, for example, mechanical float switches, sensing tubes connected to pressure transducers, ultrasonic transducers, and capacitive level sensors.

There is a need for improved motors and particularly to motors such as grinder pumps having cut-out devices for protecting the motor or other associated equipment.

SUMMARY OF THE INVENTION

In a first aspect, the present invention provides a method for operating a grinder pump station for processing and pumping sewage and inhibiting the likelihood of operation of a grinder pump assembly under at least one of a run dry condition and a blocked condition. The method includes providing the grinder pump assembly comprising a motor operably connected to a cutting mechanism and to a pump, providing a tank having an inlet for receiving sewage and in which the grinder pump assembly is receivable, and providing a wattmeter current circuit operably connected to the grinder pump assembly. Real power is measured using the wattmeter circuit during operation of the grinder pump assembly to process sewage received in the tank and discharge the processed sewage from the tank. The grinder pump assembly is automatically turned off based on the real power measured by the wattmeter circuit due to the at least one of a run dry condition and a blocked condition.

In a second aspect, the present invention provides a grinder pump assembly for processing and pumping sewage and inhibiting the likelihood of operation of the grinder pump assembly under at least one of a run dry condition and a blocked condition. The grinder pump assembly includes a motor, a cutting mechanism operably connected to the motor, a pump operably connected to the motor, a wattmeter circuit operably connected to the grinder pump assembly for measuring real power, an on/off switch for controlling electrical power to the motor, and a processor connected to the wattmeter circuit and operable to control the switch to automatically turn off the grinder pump assembly based on the real power measured by the wattmeter circuit due to the at least one of the run dry condition and the blocked condition.

In a third aspect, the present invention provides a method for protecting the operation of a motor and inhibiting the likelihood of operating the motor under an abnormal operating condition. The method includes providing a motor and a wattmeter circuit operably connected to the motor. The motor is operated and real power is measured using the wattmeter circuit. The motor is automatically turned off based on the real power measured by the wattmeter circuit due to the abnormal operating condition.

In a fourth aspect, the present invention provides a combination motor and cut-out device for protecting the operation of a motor and inhibiting the likelihood of operating the motor under an abnormal condition. The combination motor and a cut-out device includes a motor, a wattmeter circuit operably connected to the motor for measuring real power, an on/off switch for controlling electrical power to the motor, and a processor operable to control the switch to automatically turn off the motor based on the real power measured by the wattmeter circuit due to the abnormal condition.

BRIEF DESCRIPTION OF THE DRAWINGS

The subject matter which is regarded as the invention is particularly pointed out and distinctly claimed in the concluding portion of the specification. The invention, however, may best be understood by reference to the following detailed description of various embodiments and the accompanying drawings in which:

DETAILED DESCRIPTION OF THE INVENTION

Figure 1:
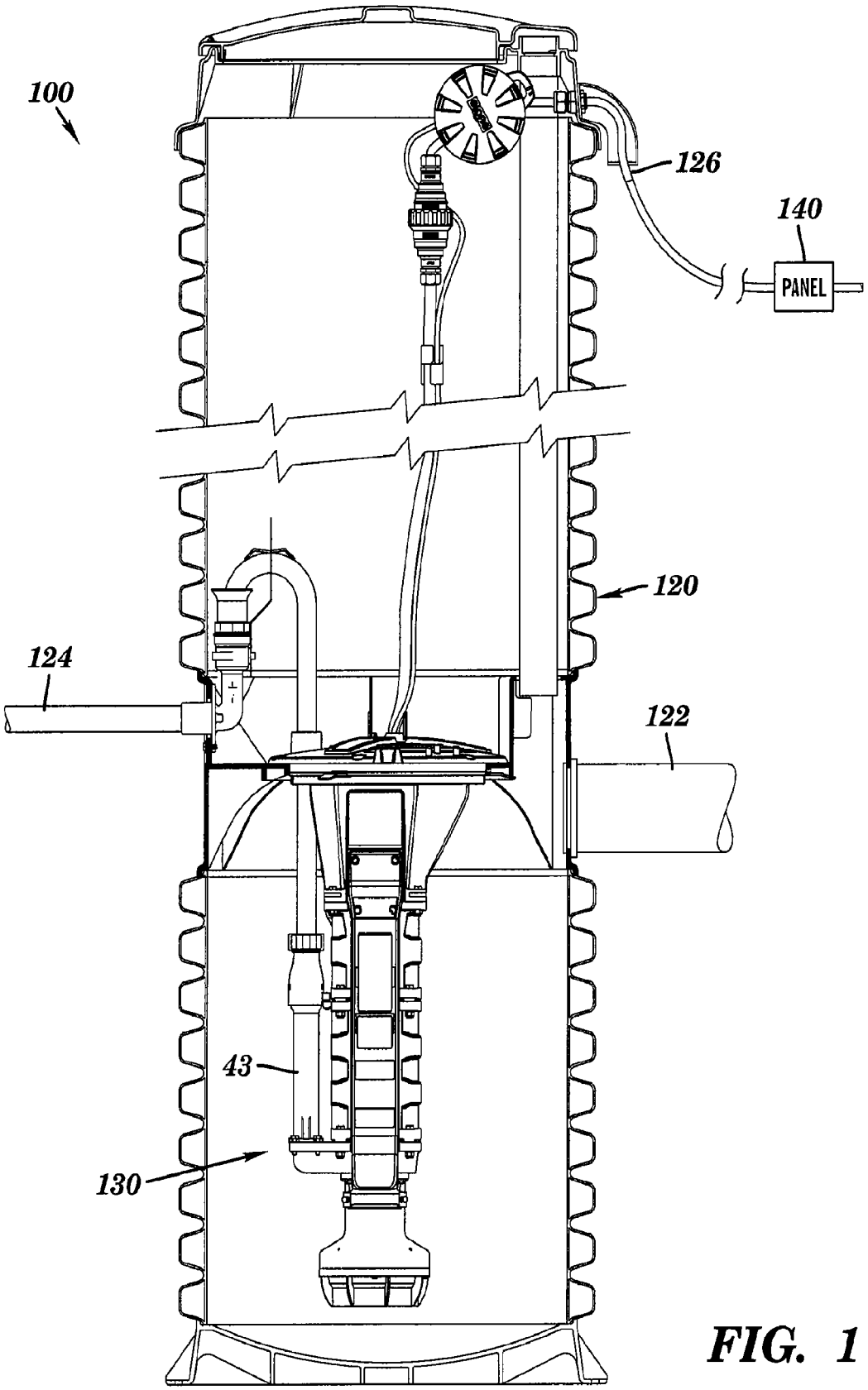
FIG. 1 is an elevational view of one embodiment of a grinder pump station in accordance with the present invention in which a grinder pump system is disposed in a tank.

FIG. 1 illustrates one embodiment of a low-pressure grinder pump station 100 in accordance with the present invention for collecting, grinding, and pumping wastewater or sewage. Grinder pump station 100 generally includes a tank 120 and a grinder pump assembly 130. Grinder pump station 100 is readily installable in the ground by connecting the station to a wastewater feed pipe 122, a wastewater discharge pipe 124, and an electrical power supply via an electrical cable 126. The system may also be connected to or include a vent.

Figure 2:
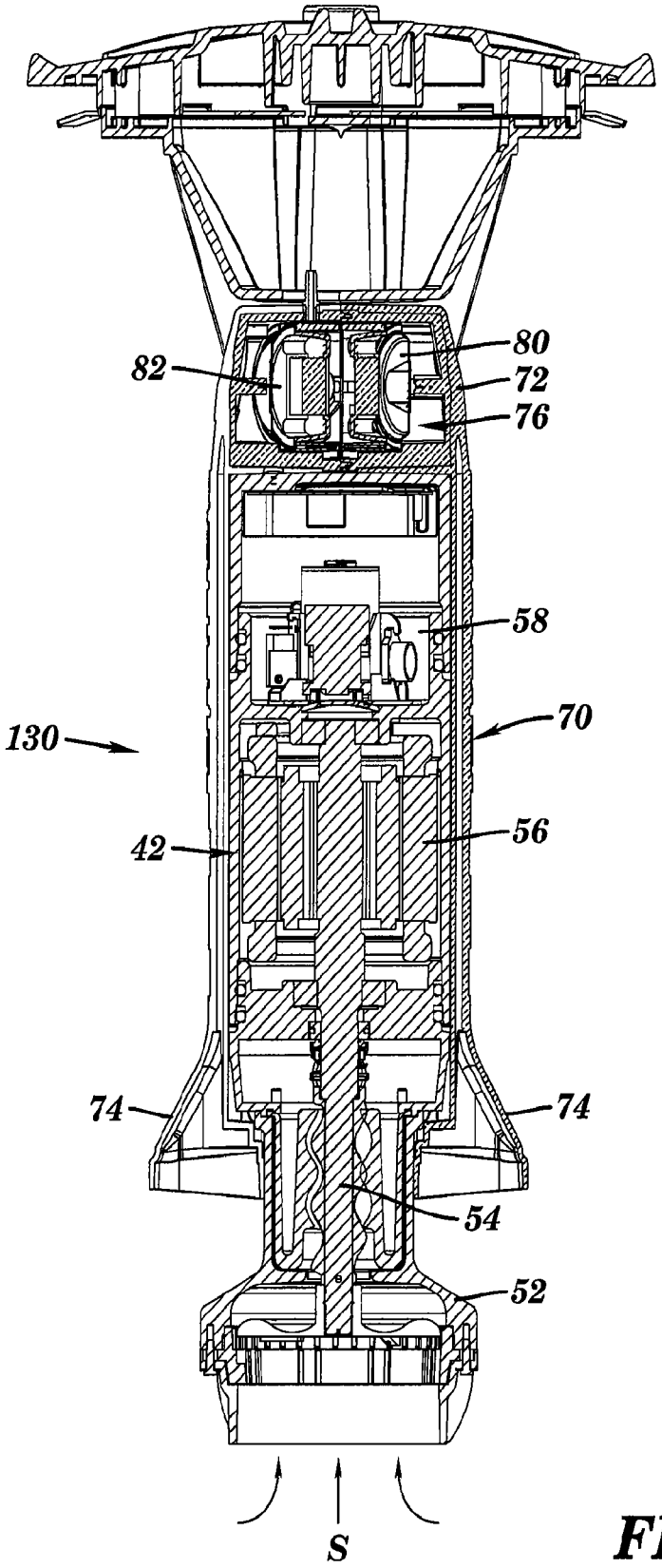
FIG. 2 is an enlarged cross-sectional view of the grinder pump assembly of FIG. 1.

With reference to FIG. 2, grinder pump assembly 130 may include a housing 42, a grinder mechanism 52, a pump assembly 54, an electric motor 56 such as an AC motor, and motor controller 58. Liquid level sensing assembly 70 includes central portion 72, which defines a cavity 76 such as a sealed chamber, and switches 80 and 82 such as pressure switches as described below.

For example, with a level sensor constructed with two point level switches, e.g., low-level/on-off switch 82 and high-level alarm switch 80, and with both switches in the closed position, the pump would be off. With an open contact in the low-level/on-off switch and a closed contact in the alarm switch, a normal run condition exists and would require the pump to turn on and purge the wastewater in the tank until the contact of the low-level/on-off switch closes. The opening and closing of the low-level/on-off switch may be at different levels. For example, the low level pressure switch may change from a normally closed contact to a normally open contact at 8 inches of wastewater and reset back to the normally closed position of 4 inches of wastewater. One system for monitoring the water or sewage level in the tank is disclosed in U.S. patent application Ser. No. 11/748,231, entitled "Wireless Liquid Level Sensing Assemblies And Grinder Pump Assemblies Employing The Same" by Capano et al., the entire subject matter of which is incorporated herein by reference.

Grinder mechanism 52 pulverizes solids or semisolid matter in the wastewater. Pump assembly 54 is attached to grinder mechanism 52 for pumping the ground wastewater through grinder pump assembly 130. Electric motor 56 powers both grinder mechanism 52 and pump assembly 54. For example, a grinder mechanism may include a stationary outer ring and a rotating cutting blade, and a pump assembly may include a progressing cavity pump having a pump housing, a pump stator, and a pump rotor. In operation, wastewater is drawn into grinder mechanism 52, as illustrated by the curved arrows S in FIG. 2, for cutting or grinding of the solids or semisolid matter in the wastewater. The resulting processed particulate effluent passes through pump assembly 54, a pipe 43 (FIG. 1), and then through wastewater discharge pipe 124 (FIG. 1) to a remote location, e.g., to a pressure wastewater main and ultimately to a wastewater treatment plant.

Figure 3:
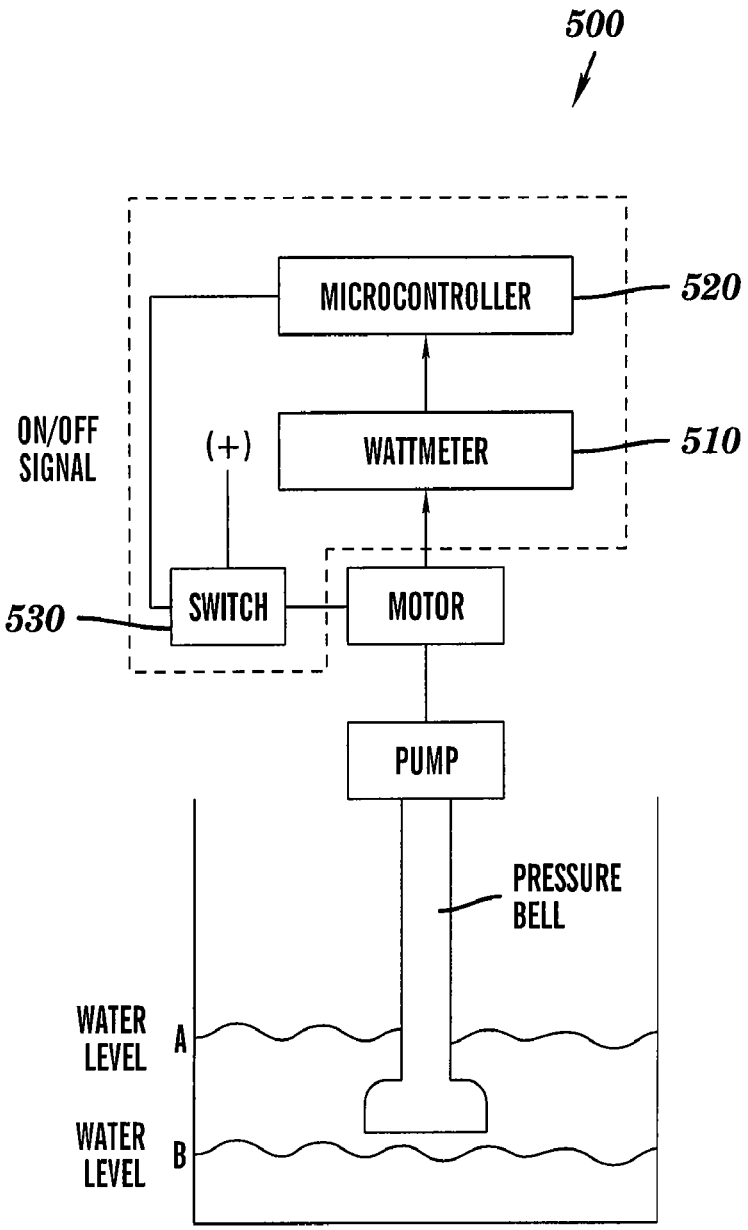
FIG. 3 is a diagrammatic illustration of the motor cut-out device in accordance with the present invention employed in the grinder pump station of FIG. 1.

With reference now to FIG. 3, schematically illustrated is one embodiment of a motor cut-out device 500 in accordance with the present invention for the grinder pump station.

The motor cut-out device may include a wattmeter circuit 510 operably connected to the motor (for measuring voltage, current, and their phase relationship) and to a microcontroller or processor 520. Microcontroller or processor 520 may be connected to an on/off switch 530 for controlling electrical power to the motor. The microcontroller or processor and the wattmeter circuit may be disposed in a panel 140 (FIG. 1) disposed away from the grinder pump station. For example, the panel may be attached to the outside or inside of a building. It will be appreciated that the microcontroller or processor may be disposed in the grinder pump assembly. In addition, the on/off switch may be part of or incorporated into motor controller 58 (FIG. 2).

A run dry condition is a state where the pump motor has been running and causes the liquid level to fall below, for example, the pressure bell housing connected to a pressure low-level/on-off switch, and possibly at or below the cutting mechanism. This may be because the low-level on/off pressure switch has failed and, therefore, is unable to switch the motor off. Since water is necessary to lubricate the pump such as a pump stator, a run dry condition lasting more than about 20 seconds may permanently destroy the stator.

The motor cut-out device of the present invention shuts off the pump motor in the event of a run dry condition, or shuts off the pump motor where the liquid or sewage is less than the full head or less than a particular level of the sewage. The motor cut-out device in accordance with the present invention employs wattmeter circuitry for determining when to shut off the pump motor. For example, wattage is a useful indicator of the run dry state as described in detail below. Initially, wattage is described as the real power (average over time in units, e.g., watts) into a load (i.e., the motor) and is given by:

$$P = VI\cos\theta$$

where V is the motor voltage, I is the motor current and θ is the phase angle between them.

Generally, when inductance (as exists in a motor) or capacitance is present in an AC circuit, voltage and current do not rise and fall together (i.e., the phase angle is not zero). When there exists a non-zero phase angle, power can be split into a component which does useful work and is measured in watts as well as a component which does not and is measured in vars (volt-amperes reactive). The power factor of an AC electric power system is defined as the ratio of the real power to the apparent power, and is a number between 0 and 1 (frequently expressed as a percentage, e.g. 0.5 pf=50% pf, and corresponds to cos θ in the formula above). Real power is the capacity of the circuit for performing work in a particular time.

Due to the magnetic behavior of the cores used in the pump motor only a small change in current (approximately 3%) is seen as a pump makes the transition from pumping water or sewage (the normal state) to pumping air (the abnormal run dry state).

The phase angle shows a greater change, increasing by as much as 11 degrees at the transition (this corresponds to approximately an 18% change), due to the reduction in work needed to pump air. However, the product of the real power factors—the motor voltage, the small current change, and the larger phase angle change—(which gives approximately a 40% change), provides a sensitive and quick transition point indicator.

A suitable conventional analog or digital wattmeter circuit may be employed in the present invention. The measurement of the current may be obtained by connections in series with the power supplied to the motor, while the potential or voltage may be obtained by connections made in parallel with the power supplied to the motor. An analog wattmeter may be configured to simultaneously measure the voltage and current, and provide an output that is proportional to the average, across at least one sinusoidal period, of the instantaneous product of voltage and current, thus measuring real or true power, and possibly (depending on load characteristics)

showing a different reading to that obtained by simply multiplying the readings showing on a stand-alone voltmeter and a stand-alone ammeter in the same circuit.

A digital wattmeter circuit may be employed to sample the voltage and current thousands of times a second. The time average of the product of the instantaneous voltage multiplied by the instantaneous current is the real power.

In both of the analog and digital examples above, the reason for using real power in the cutout device is that it provides a number proportional to the true mechanical power expended in discharging the effluent and this number is easily obtained by numerical multiplication of the voltage and current over time followed by averaging. This technique of the present invention eliminates the need to provide circuitry such as a rectifier for specifically monitoring or measuring and determining the phase angle between the voltage and the current.

Figure 4:
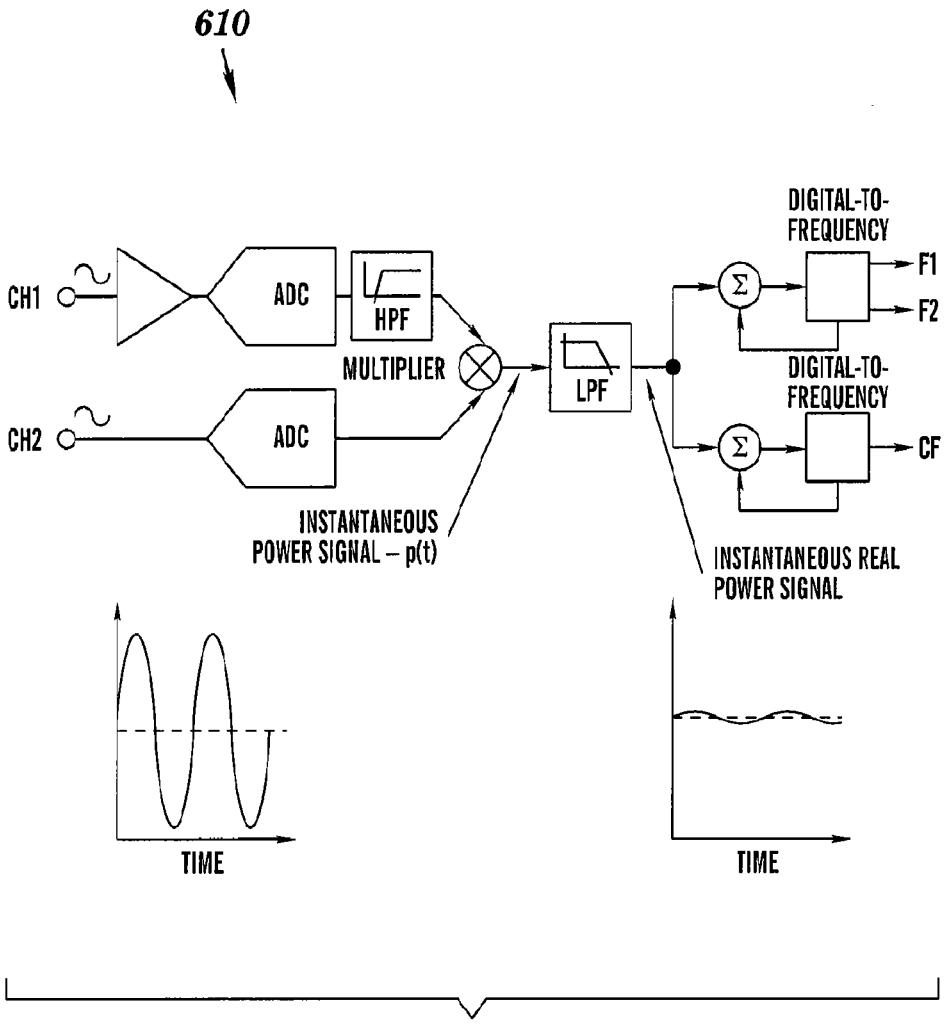
FIG. 4 is one embodiment of a diagram for a wattmeter circuit for the motor cut-out device of FIG. 3.

FIG. 4 illustrates one preferred wattmeter circuit 610 for determining the real power usage of the motor. A suitable wattmeter circuit employable in the present invention is Energy Metering IC (integrated circuit) with Integrated Oscillator and Reverse Polarity Indication, model no. AD71056, which is used for power meters for measuring electrical power supplied to residential homes or businesses. Integrated chip model no. AD71056 is available from Analog Devices of Norwood, Mass. From the present description, it will be appreciated that other wattmeter circuits may be suitably employed.

A shunt or a transformer may be employed as the current sensor. A resistor divider may be used to provide a voltage signal that is proportional to the line voltage. The two analog-to-digital converters (ADCs) in the AD71056 energy metering chip digitize the voltage signals from the current and voltage sensors. A high-pass filter (HPF) in the current channel removes any dc component from the current signal. The real power calculation is derived from the instantaneous power signal. The instantaneous power signal is generated by a direct multiplication of the current and voltage signals. To extract the real power component (that is, the dc component), the instantaneous power signal is low-pass filtered. Again, this technique of the present invention eliminates the need to provide circuitry such as a rectifier for specifically monitoring or measuring and determining the phase angle between the voltage and the current.

The low frequency outputs (F1, F2) of the AD71056 energy metering chip are generated by accumulating this real power information. This low frequency inherently means a long accumulation time between output pulses. Consequently, the resulting output frequency is proportional to the average real power. This average real power information is then accumulated (for example, by a counter) to generate real energy information. Conversely, due to its high output frequency and, hence, shorter integration time, the CF output frequency is proportional to the instantaneous real power.

Figure 5:
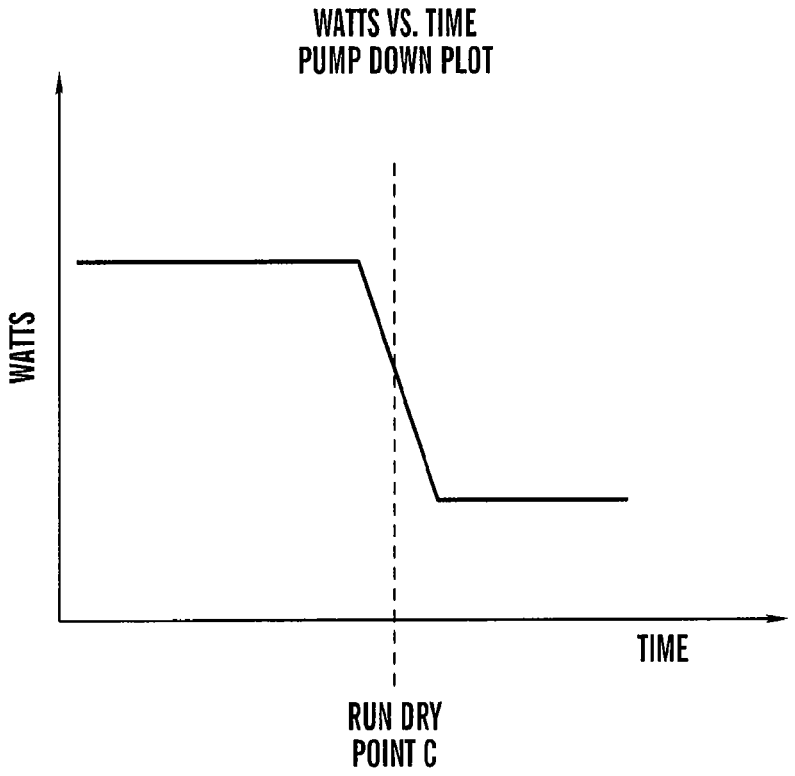
FIG. 5 is a graph of watts verses time for pump down of the grinder pump station observed by the wattmeter circuit of FIG. 4.

In operation, for example, the microcontroller or processor looks for the change from about 750 watts in the 240 V motor when the system is pumping water with no head, to about 460 watts, when the system is just starting to pump air, as graphically shown in FIG. 5. The microcontroller or processor may be suitably programmed to effect the features of the present invention for operating a grinder pump station for processing and pumping sewage and inhibiting the likelihood of operation of a grinder pump assembly under at least one of a run dry condition and a blocked condition, or method for protecting the operation of a motor and inhibiting the likelihood of operating the motor under an abnormal operating condition. Through a recognition algorithm, which takes into account motor construction variations, the microcontroller or processor may shut off the pump. For example, the controller or processor may be suitably programmed to detect a predetermined percent change for triggering the turning off of the motor, or compare the detected real power to a predetermined real power amount for triggering the turning off of the motor, or provide other suitable programming for monitoring and triggering the turning off of the motor due to the changing measured real power due to a run dry or blocked condition. The microcontroller or processor may also allow for adjustably setting when the microcontroller or processor triggers the shutting on or off of the motor, e.g., allowing a user or technician to set the amount of change in the real power required to be detected, or the value of the real power to be detected, or other suitable adjustably settable parameters. A suitable microcontroller or processor is model no. MC68HC908AP available from Freescale Semiconductor of Austin, Tex.

In addition, the microcontroller or processor may send a signal indicative of an error condition, e.g., run dry condition or blocked condition. Further, the microcontroller or processor may attempt a number of retries (turning on the pump, monitoring the real power supplied to the motor, and turning off the motor if a change in the real power is again detected) before annunciating an error condition.

Figure 6:
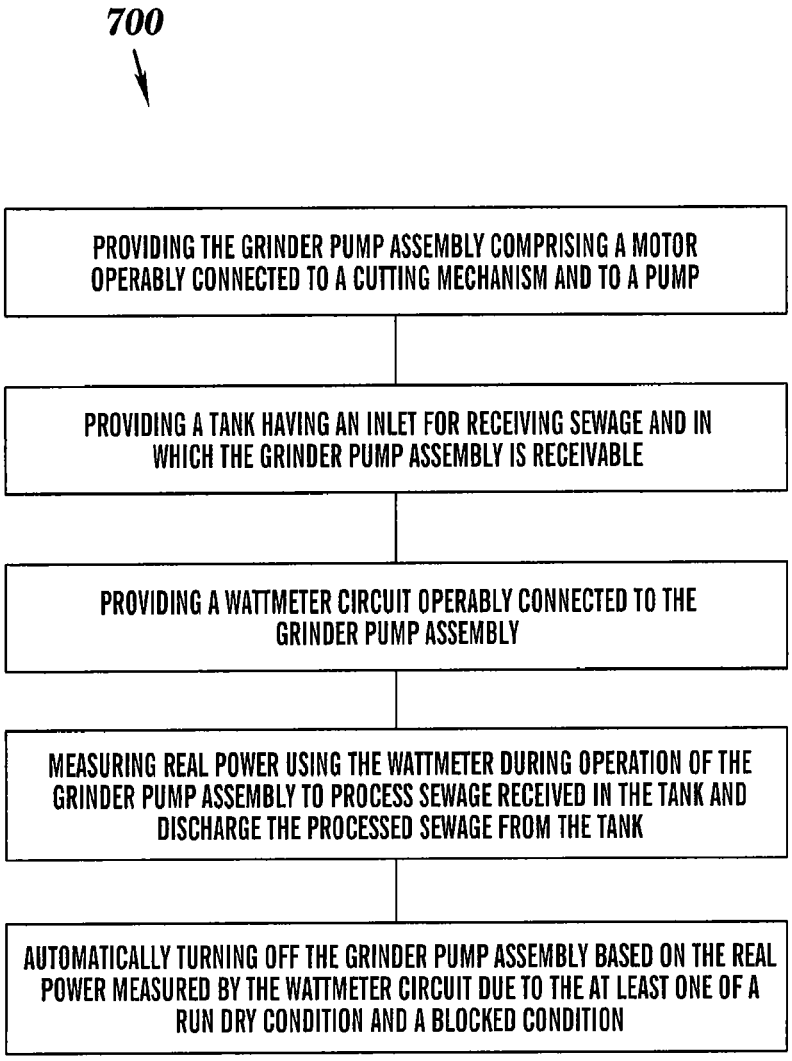
FIG. 6 is a flowchart of a method for operating a grinder pump station for processing and pumping sewage and inhibiting the likelihood of operation of a grinder pump under at least one of a run dry condition and a blocked condition.

FIG. 6 is a flowchart of one embodiment for a method 700 for operating a grinder pump station for processing and pumping sewage and inhibiting the likelihood of operation of a grinder pump assembly under at least one of a run dry condition and a blocked condition. The method includes providing the grinder pump assembly comprising a motor operably connected to a cutting mechanism and to a pump, providing a tank having an inlet for receiving sewage and in which the grinder pump assembly is receivable, and providing a wattmeter circuit operably connected to the grinder pump assembly. Real power is measured using the wattmeter during operation of the grinder pump assembly to process sewage received in the tank and discharge the processed sewage from the tank. The grinder pump assembly is automatically turned off based on the real power measured by the wattmeter circuit due to the at least one of a run dry condition and a blocked condition.

Having the ability to sense real or true power also allows the device employing the wattmeter circuit, in conjunction with the microcontroller, to shut off the pump under a blocked head, or other overpressure, condition. Thus, a relatively inexpensive motor cut-out device may protect and extend the life of the pump motor.

Thus, while various embodiments of the present invention have been illustrated and described, it will be appreciated to those skilled in the art that many changes and modifications may be made thereunto without departing from the spirit and scope of the invention.

The invention claimed is:

1. A method for operating a grinder pump station for processing and pumping sewage and inhibiting the likelihood of operation of a grinder pump assembly under at least one of a run dry condition and a blocked condition, the method comprising:

providing the grinder pump assembly comprising a motor operably connected to a cutting mechanism and to a pump;

providing a tank having an inlet for receiving sewage and in which the grinder pump assembly is receivable;

providing a wattmeter circuit operably connected to the grinder pump assembly;

measuring real power using the wattmeter circuit without determining a power factor or a phase angle during operation of the grinder pump assembly to process sewage received in the tank and discharge the processed sewage from the tank; and automatically turning off the grinder pump assembly based on the real power measured by the wattmeter circuit without determining a power factor or a phase angle due to the at least one of a run dry condition and a blocked condition.

2. The method of claim 1 wherein the measuring comprises measuring real power using the wattmeter circuit based on the average value of the product of instantaneous values of voltage and current over time.

3. The method of claim 1 wherein the automatically turning off the grinder pump assembly comprises automatically turning off the grinder pump assembly based on a reduction in the real power measured by the wattmeter circuit due to a run dry condition.

4. The method of claim 1 wherein the automatically turning off the grinder pump assembly comprises automatically turning off the grinder pump assembly based on an increase in the real power measured by the wattmeter circuit due to the blocked condition.

5. The method of claim 1 further comprising automatically cycling the turning on and off of the grinder pump assembly based on the measured real power using the wattmeter circuit during operation of the grinder pump assembly to process sewage received in the tank and discharge the processed sewage from the tank.

6. The method of claim 1 wherein the automatically turning off the grinder pump assembly comprises automatically turning off the grinder pump assembly based on at least a 40 percent reduction in the real power measured by the wattmeter circuit.

7. The method of claim 1 wherein the automatically turning off the grinder pump assembly comprises adjustably setting when to automatically turning off of the grinder pump assembly based on the real power measured by the wattmeter circuit.

8. The method of claim 1 further comprising generating an alarm signal indicating the at least one of the run dry condition and the blocked condition.

9. A grinder pump assembly for processing and pumping sewage and inhibiting the likelihood of operation of said grinder pump assembly under at least one of a run dry condition and a blocked condition, said grinder pump assembly comprising:

a motor;

a cutting mechanism operably connected to said motor;

a pump operably connected to said motor;

a wattmeter circuit operably connected to said grinder pump assembly for measuring real power without determining a power factor or a phase angle;

an on/off switch for controlling electrical power to said motor; and a processor connected to said wattmeter circuit and operable to control said switch to automatically turn off said grinder pump assembly based on the real power measured by said wattmeter circuit without determining a power factor or a phase angle due to the at least one of the run dry condition and the blocked condition.

10. The grinder pump assembly of claim 9 wherein said wattmeter circuit is operable to measure real power based on the average value of the product of instantaneous values of voltage and current over time.

11. The grinder pump assembly of claim 9 wherein said processor is operable to control said switch to automatically turn off said motor based on a reduction in the real power measured by said wattmeter circuit due to the run dry condition.

12. The grinder pump assembly of claim 9 wherein said processor is operable to control said switch to automatically turn off said motor based on an increase in the real power measured by said wattmeter circuit due to the blocked condition.

13. The grinder pump assembly of claim 9 wherein said processor is operable to control said switch to automatically cycle the turning on and off of said grinder pump assembly based on the measured real power using said wattmeter circuit during operation of said grinder pump assembly to process sewage received in said tank and discharge the processed sewage from said tank.

14. The grinder pump assembly of claim 9 wherein said processor is operable to control said switch to automatically turn off said grinder pump assembly based on at least a 40 percent reduction in the real power measured by said wattmeter circuit.

15. The grinder pump assembly of claim 9 wherein said processor is operable to adjustably set when to control said switch to automatically turn off of said grinder pump assembly based on the real power measured by said wattmeter circuit.

16. The grinder pump assembly of claim 9 wherein said processor is operable to generating an alarm signal indicating the at least one of the run dry condition and the blocked condition.

17. The grinder pump assembly of claim 9 further comprising a tank having an inlet for receiving sewage and in which said grinder pump assembly is receivable for discharging processed sewage from said tank.

18. A method for protecting the operation of a motor and inhibiting the likelihood of operating the motor under an abnormal operating condition, the method comprising:

providing a motor;

providing a wattmeter circuit operably connected to the motor;

operating the motor;

measuring real power using the wattmeter circuit without determining a power factor or a phase angle; and automatically turning off the motor based on the real power measured by the wattmeter circuit without determining a power factor or a phase angle due to the abnormal operating condition.

19. The method of claim 18 wherein the measuring comprises measuring real power using the wattmeter circuit based on the average value of the product of instantaneous values of voltage and current over time.

20. The method of claim 18 wherein the automatically turning off the motor comprises automatically turning off the motor based on a reduction in the real power measured by the wattmeter circuit due to the abnormal operating condition.

21. The method of claim 18 wherein the automatically turning off the motor comprises automatically turning off the motor based on an increase in the real power measured by the wattmeter circuit due to the abnormal operating condition.

22. The method of claim 18 further comprising automatically cycling the turning on and off of the motor based on the measured real power using the wattmeter during operation of the motor.

23. The method of claim 18 wherein the automatically turning off the motor comprises automatically turning off the motor based on at least a 40 percent reduction in the real power measured by the wattmeter circuit.

24. The method of claim 18 wherein the automatically turning off the motor comprises adjustably setting when to automatically turning off of the motor based on the real power measured by the wattmeter circuit.

25. The method of claim 18 further comprising generating an alarm signal indicating the at least one of the run dry condition and the blocked condition.

26. A combination motor and cut-out device for protecting the operation of a motor and inhibiting the likelihood of operating said motor under an abnormal condition, said combination motor and a cut-out device comprising:

a motor;

a wattmeter circuit operably connected to said motor for measuring real power without determining a power factor or a phase angle;

an on/off switch for controlling electrical power to said motor; and a processor operable to control said switch to automatically turn off said motor based on the real power measured by said wattmeter circuit without determining a power factor or a phase angle due to the abnormal condition.

27. The combination motor and cut-out device of claim 26 wherein said wattmeter circuit is operable to measure real power based on the average value of the product of instantaneous values of voltage and current over time.

28. The combination motor and cut-out device of claim 26 wherein said processor is operable to control said switch to automatically turn off said motor based on a reduction in the real power measured by the wattmeter circuit due to the abnormal condition.

29. The combination motor and cut-out device of claim 26 wherein said processor is operable to control said switch to automatically turn off said motor based on an increase in the real power measured by the wattmeter circuit due to the abnormal condition.

30. The combination motor and cut-out device of claim 26 wherein said processor is operable to control said switch to automatically cycle the turning on and off of said motor based on the measured real power using said wattmeter circuit.

31. The combination motor and cut-out device of claim 26 wherein said processor is operable to control said switch to automatically turn off said motor based on at least a 40 percent reduction in the real power measured by said wattmeter circuit.

32. The combination motor and cut-out device of claim 26 wherein said processor is operable to adjustably set when to control said switch to automatically turn off of said motor based on the real power measured by said wattmeter circuit.

33. The combination motor and cut-out device of claim 26 wherein said processor is operable to generating an alarm signal indicating the at least one of the run dry condition and the blocked condition.

* * * * *